US005105611A

United States Patent [19]

Zumfeld et al.

[11] Patent Number: 5,105,611

[45] Date of Patent: Apr. 21, 1992

[54] YARN SPLICING DEVICE

[75] Inventors: Heinz Zumfeld; Reinhard Mauries, both of Monchen-Gladbach, Fed. Rep. of Germany

[73] Assignee: W. Schlafhorst & Co., Monchen-Gladbach, Fed. Rep. of Germany

[21] Appl. No.: 229,605

[22] Filed: Aug. 8, 1988

[30] Foreign Application Priority Data

Aug. 8, 1987 [DE] Fed. Rep. of Germany ..... 3726507

[51] Int. Cl.[5] ..... D01H 15/00

[52] U.S. Cl. ..... 57/22

[58] Field of Search ..... 57/22, 23, 261, 350

[56] References Cited

U.S. PATENT DOCUMENTS

| | | | |
|---|---|---|---|
| 3,707,837 | 1/1973 | Gibbon | 57/350 X |
| 4,424,663 | 1/1984 | Rohner et al. | 57/22 |
| 4,432,194 | 2/1984 | Luz | 57/22 |
| 4,438,621 | 3/1984 | Rohner | 57/22 |
| 4,452,035 | 6/1984 | Rohner et al. | 57/22 |
| 4,497,165 | 2/1985 | Völlm | 57/22 |
| 4,505,098 | 3/1985 | Baba | 57/22 |
| 4,507,912 | 4/1985 | Noguchi | 57/261 X |
| 4,538,407 | 9/1985 | Matsui et al. | 57/22 |
| 4,565,059 | 1/1986 | Mima | 57/22 |
| 4,566,260 | 1/1986 | Irmen | 57/22 |
| 4,571,928 | 2/1986 | Rohner | 57/22 |
| 4,630,433 | 12/1986 | Premi | 57/22 |
| 4,653,258 | 3/1987 | Rohner | 57/22 |
| 4,686,821 | 8/1987 | Maruki | 57/22 |
| 4,693,066 | 9/1987 | Oellers | 57/22 |
| 4,693,067 | 9/1987 | Locatelli | 57/22 |
| 4,738,093 | 4/1988 | Zumfeld et al. | 57/22 |
| 4,765,128 | 8/1988 | Rosen et al. | 57/22 |

*Primary Examiner*—Joseph J. Hail, III

*Attorney, Agent, or Firm*—Shefte, Pinckney & Sawyer

[57] ABSTRACT

In a yarn splicing device having a splicing head defining a splicing chamber and a yarn insertion slot, a compressed air passageway network is formed for delivering compressed air into the splicing chamber, the passageway arrangement having opposed air discharge passageways which extend laterally with respect to the splicing chamber in spaced relation therealong in a common plane at the back side of the chamber opposite its entrance slot to open tangentially into the chamber in opposite directions for contacting the yarn ends with one another for splicing.

11 Claims, 2 Drawing Sheets

YARN SPLICING DEVICE

BACKGROUND OF THE INVENTION

The present invention relates to a yarn splicing device of the type having a splicing head which defines a splicing chamber and a slot opening thereunto for insertion of yarn ends to be spliced with a compressed air passageway network for directing splicing air through air exit passageways opening into the chamber.

West German Offenlegungsschrift DE-PS 30 40 661 discloses a yarn splicing device of the basic above-described type wherein splicing is accomplished by insertion of two yarn ends to be spliced in parallel relationship into the splicing chamber and subjecting the yarn ends to compressed air emitted into the splicing chamber through a pair of air discharge openings. It is common to subject the yarn ends to be spliced to an air vortex preparatory to placement of the yarn ends within the splicing chamber for actual splicing, in order to initially open the yarn ends which aids in conforming the subsequently-formed splice to the normal diameter of the yarn.

The quality of a yarn splice is essentially dependent on the proper delivery of compressed splicing air into the splicing chamber during the splicing operation. Specifically, it is important that the compressed splicing air be caused to circulate within the splicing chamber in conformity to the original twist of the yarn in order to connect the opened yarn ends to one another in a twisted fashion which does not differ considerably from the original yarn.

SUMMARY OF THE INVENTION

It is accordingly an object of the present invention to provide a yarn splicing device having an arrangement for controlling the supply of compressed splicing air into the splicing chamber to best achieve optimal splicing results. In accordance with this object, the present invention provides a splicing device having a splicing head defining a splicing chamber and a slot opening into the splicing chamber for insertion of yarn ends to be spliced. A passageway arrangement is formed in the splicing head for directing compressed air into the splicing chamber for performing splicing of the yarn ends. According to the present invention, the passageway arrangement includes opposed air discharge passageways which extend in spaced relationship to one another in a common plane at the back side of the chamber opposite its entrance slot and which open tangentially into the chamber in opposite directions for contacting the yarn ends with one another for splicing.

This passageway arrangement advantageously effects direct entrainment and swirling of the yarn ends at the rear of the splicing chamber by the tangential flow of compressed air into the chamber. In conventional splicing devices, yarn ends to be spliced may be located within the back of the splicing chamber but the splicing air is emitted into the chamber at a spacing from the back of the chamber and travels a distance along the chamber walls in reaching the yarn ends whereby a danger exists that the yarn ends may be subjected to a beating or fluttering action when entrained by the circulating air. In contrast, the orientation of the air discharge passageways in the present invention causes the compressed splicing air to be emitted at spaced or staggered locations directly against the yarn ends to be spliced so as to press the previously-opened yarn ends directly against one another to allow their individual fibers to intimately contact each other as the yarn ends are entrained in a swirling fashion by the splicing air. The staggering of the air discharge passageways may be selected to produce swirling entrainment of the yarn ends within the splicing chamber in either clockwise or counter-clockwise directions to conform to the S-twist or Z-twist of the yarn ends being spliced.

Thus, in the present invention, each air discharge passageway produces an air vortex within the splicing chamber which directly contact and entrain the adjacent yarn ends within the chamber to twist them intimately with one another in the same direction as the twist of the original yarn to form a visually pleasing yarn splice.

Preferably, the splicing chamber is longitudinal with a circular cross-section and the passageway arrangement provides two air discharge passageways spaced along the length of the chamber in order to achieve an optimal guidance of the splicing air and optimal formation of air vortices.

According to a further aspect of the present invention, the passageway arrangement provides a compressed air feed passageway and a compressed air chamber for receiving splicing air from the feed passageway for delivery to the air discharge passageways. The feed passageway is arranged to open into the compressed air chamber symmetrically with respect to the air discharge passageways and perpendicularly with respect to their common plane. Connector passageways extend respectively from the compressed air chamber to the air discharge passageways symmetrically with respect to the air discharge passageways.

Advantageously, this passageway arrangement assures that the compressed splicing air is uniformly distributed to each of the air discharge passageways at substantially the same air flow rate to avoid the occurrence of uncontrolled and undesired air flow conditions within the splicing chamber resulting from an uneven air flow through the air discharge passageways.

In accordance with another feature of the present invention, the splicing head is removably mounted on a base through which the compressed air feed passageway extends and the compressed air chamber is formed in the splicing head generally at its mounting location to the base for communication with the feed passageway.

For example, the base may include an outwardly extending conduit portion which defines a terminal end portion of the feed passageway and the splicing head may be provided with a suitable mounting opening for receiving the conduit portion of the base. In such construction, the conduit portion of the base functions to maintain the splicing head centered in proper mounting relationship to the base. Thus, a single fastener, e.g. a retaining screw or the like, is sufficient for fastening the splicing head to the base. Further, in this construction, a terminal portion of the mounting opening in the splicing head may form the compressed air chamber.

The splicing head in the present yarn splicing device may be of either a monopartite or bipartite construction. In an embodiment of a bipartite construction, the splicing head includes first and second members defining therebetween the compressed air chamber, with the first member defining the splicing chamber and the second member being removably mounted to the base, for example in the above-described manner. This bipartite construction provides the advantage of being simple to manufacture and easy to operate, while also incorporating the aforedescribed symmetrical air passageway arrangement to insure that the compressed splicing air is transported into the splicing chamber uniformly through the opposed air discharge passageways.

It is further preferred that the splicing head be equipped with yarn guide devices which assist in simplifying the insertion of yarn ends through the slot into the splicing chamber. Additionally, the splicing device may be provided with a cover for closing the splicing chamber during the splicing operation. The cover avoids undesired passage of the splicing air out of the chamber through the entrance slot before splicing air vortices form and further prevents undesired movement of individual fibers or even an entire yarn end out of the splicing chamber.

The cover of the splicing device may also include yarn holders for retaining the yarn ends within the splicing chamber. In the preferred embodiment, the yarn guide devices of the splicing head cover a portion of the cross-section of the splicing chamber at each end thereof while the yarn holders of the cover are arranged to cover part of the cross-section of the splicing chamber at each end left uncovered by the yarn guide devices. Thus, the yarn guide devices and the yarn holders cooperatively serve to insure that yarn ends inserted within the splicing chamber are positioned at the back side of the chamber opposite the entrance slot whereat the yarn ends are in the air emission zones of the air discharge passageways.

DESCRIPTION OF THE PREFERRED EMBODIMENT

Figure 1:
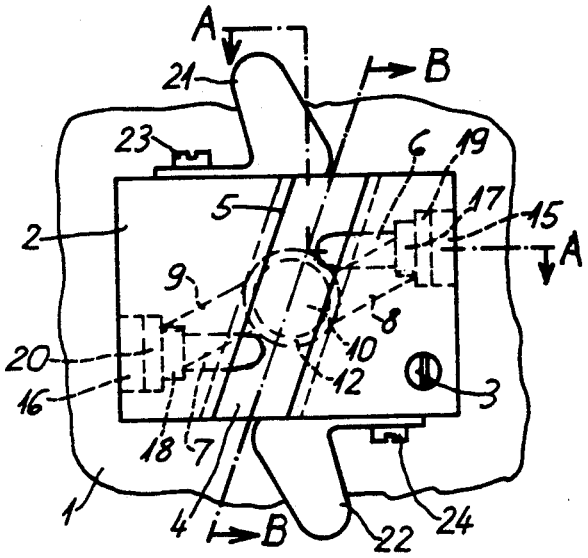
FIG. 1 is a front elevational view of a yarn splicing device according to one embodiment of the present invention.
Figure 3:
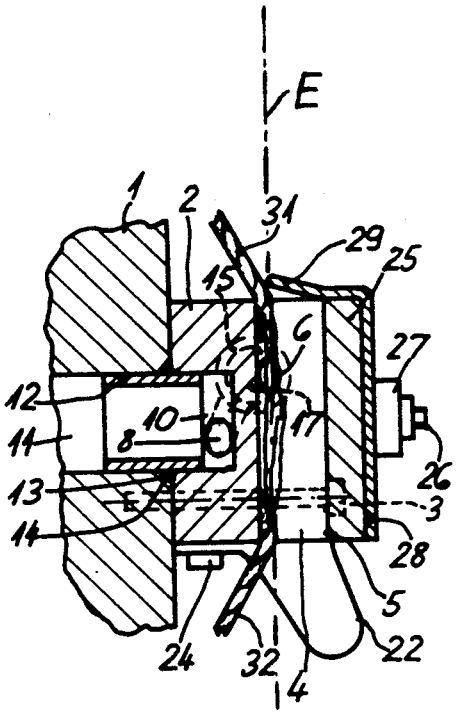
FIG. 3 is a vertical cross-sectional view of the splicing device of FIG. 1 taken along line B—B thereof.
Figure 2:
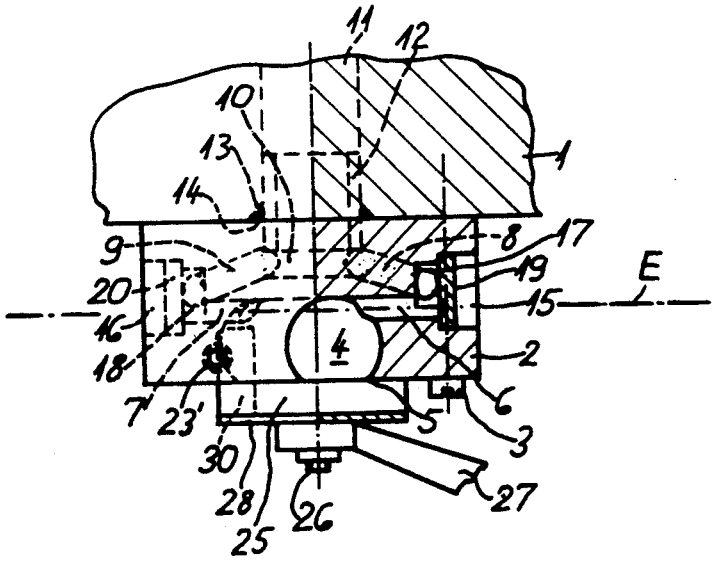
FIG. 2 is a top view of the splicing device of FIG. 1, shown partially in plan and partially in horizontal cross-section taken along line A—A of FIG. 1.

Referring now to the accompanying drawings and initially to FIGS. 1-3, a first embodiment of a yarn splicing device according to the present invention includes a splicing head 2 fastened to a base 1 by single screw 3. The splicing head 2 is formed by a monopartite body defining a longitudinal splicing chamber 4 of essentially circular cross-section which extends through the body at an oblique angle to vertical. A longitudinal slot 5 formed through the front of the splicing head 2 opens into the splicing chamber 4 to facilitate insertion of yarn ends to be spliced into the chamber 4.

An arrangement of passageways are formed as intersecting bores through the body of the splicing head 2 for directing compressed air into the splicing chamber 4 for effecting splicing of yarn ends inserted into the chamber 4. Two opposed air discharge passageways 6, 7 extend in a common plane E (FIGS. 2 and 3) at the back or bottom side of the splicing chamber 4, i.e. diametrically opposite the entrance slot 5, at a spacing from one another along the longitudinal extent of the chamber and respectively open tangentially into the splicing chamber 4 in opposite directions for emitting compressed splicing air into the chamber 4. A compressed air entrance bore is formed in the rearwardly-facing side of the splicing head 2 opposite its entrance slot 5 centrally symmetrical with respect to the air discharge passageways 6, 7 in perpendicular relation to their common plane E and to the splicing chamber 4 to form a compressed air chamber 10 at the inward end of the bore. Connector passageways 8, 9 extend respectively from the compressed air chamber 10 into communication with the air discharge passageways 6, 7 symmetrically with respect to the longitudinal axis B—B of splicing chamber 4 to be symmetrical with respect to the air discharge passageways 6, 7. As seen in FIGS. 2, 3, a compressed air feed passageway 11 is formed through the base 1 for delivering compressed air from a suitable source into the compressed air chamber 10. The base 1 includes a pipe or conduit 12 fitted in the terminal end of the feed passageway 11 and extending outwardly therefrom. The central bore formed in the splicing head 2 is dimensioned to snugly receive the projecting extent of the conduit 12 to facilitate mounting of the splicing head 2 onto the base 1. The conduit 12 thus serves to maintain the splicing head 2 centered with respect to the base 1 with the feed passageway 11 of base 1 and the central bore of the splicing head 2 in aligned communication, whereby only the single retaining screw 3 is required to secure the splicing head 2 to the base 1. The conduit 12 is only partially received in the central bore of the splicing head 2 so that the interior terminal extent of the bore not occupied by the conduit 12 forms the compressed air chamber 10. As seen in FIG. 2, a chamfer 13 is formed in the mounting surface of the base 1 annularly about the feed passageway 11 and receives an annular sealing ring 14 to establish a seal between the base 1 and the splicing head 2 about the conduit 12.

The manner in which the air discharge passageways 6, 7 and the connector passageways 8, 9 are formed in the splicing head 2 for intersecting communication with one another may best be seen and understood from FIG. 1. To form the air discharge passageways 6, 7, bores 15, 16 of considerably larger diameter are respectively formed laterally in opposite sides of the splicing head 2 in coaxial alignment with the intended location of the air discharge passageways 6, 7 and then bores 17, 18 of a considerably smaller diameter are respectively formed laterally in the splicing head 2 coaxially with the respective bores 15, 16. The air discharge passageways 6, 7 are then respectively formed as bores coaxial with the bores 15, 16 and 17, 18 to extend from the bores 17, 18 and open tangentially into the splicing chamber 4, as above-described. Similarly, the connector passageways 8, 9 are formed by bores respectively extending symmetrically with respect to one another obliquely from the respective bores 17, 18 to open into the compressed air chamber 10, which as aforementioned is defined by the air entrance bore formed in the rearwardly-facing surface of the splicing head 2. The bores 15, 16 are fitted with closure plugs 19, 20, respectively, to prevent escapage of compressed air as it flows through the connector passageways 8, 9 into the respective air discharge passageways 6, 7 at the locations of their junctures respectively within the bores 17, 18.

Thus, the complete flow pathway of compressed air through the feed passageway 11 within the base 1 into the compressed air chamber 10 of the splicing head 2 and therefrom into the respective connector passageways 8, 9 and air discharge passageways 6, 7 for delivery into the splicing chamber 4 may best be seen in FIG. 2, which as aforementioned illustrates the yarn splicing device partially in top plan view and partially in horizontal cross-section taken along line A—A of FIG. 1 through the axis of the uppermost air discharge passageway 6. As will therefore be recognized, the flow of compressed air supplied to the splicing chamber 4 is symmetrical through each of the connector passageways 8, 9 into the respective bores 17, 18 and therefrom through the air discharge passageways 6, 7 into the splicing chamber 4.

As seen in FIGS. 2 and 3, the splicing device includes a cover 25 for covering and thereby closing the yarn insertion slot 5 so that the splicing chamber 4 may be essentially closed during splicing operation. The cover 25 is preferably formed of an elastomeric material, e.g. plastic or rubber, to achieve a relatively tight seal with the splicing head 2 along the yarn insertion slot 5, even in the event the cover 25 is not fitted precisely flush to the front face of the splicing head 2. Thus, the sealed closure of the cover 25 aids in optimizing the desired formation of air vortices within the splicing chamber 4 and prevents the yarn ends 31, 32 from being blown out of the insertion slot 5 during the splicing process.

The cover 25 is supported by a plate 28 affixed to a holder arm 27 by a suitable fastening device 26. The cover 25 has been omitted from the front elevational view of the yarn splicing device of FIG. 1 for sake of clarity. The plate 28 is preferably constructed of sheet metal or a suitable stiff plastic material and is configured to substantially surround the lateral side and top contours of the cover. Yarn guide members 21, 22 are affixed respectively to the top and bottom surfaces of the splicing head 2 adjacent opposite lateral sides of the splicing chamber 4 at its upper and lower terminal ends, to assist in easy insertion of the yarn ends 31, 32 into the splicing chamber 4 through its insertion slot 5. The plate 28 of the cover 25 includes tongues 29, 30 which project from the upper and lower ends of the cover plate 28 toward the splicing head 2 to extend in partially covering relationship to the upper and lower ends of the splicing chamber 4 at the respective lateral sides thereof opposite the yarn guide members 21, 22. Thus, when the cover 25 is moved into covering relationship to the yarn insertion slot 5 of the splicing head 2, the tongues, 29, 30 function as yarn holding members to engage and push the yarn ends 31, 32 against the back or bottom side of the splicing chamber 4 and to hold the yarn ends 31, 32 in such disposition to lie directly adjacent the air discharge passageways 6, 7, all as best seen in FIG. 3. Of course, as will be recognized, the tongues 29, 30 or other suitable yarn holding members may 131 alternatively be attached to components of the splicing device other than the support plate 28 of the cover 25.

The operation of the yarn splicing device will be understood with reference to FIG. 3 wherein the device is shown in cross-section taken along line B—B of FIG. 1 through the central axis of the splicing chamber 4 generally vertically with respect to the splicing head 2 and the base 1. The yarn ends 31, 32 illustrate the positioning of yarn end to be spliced when inserted within the splicing chamber 4. The cover 25 is illustrated in sealing relationship with the forward face of the splicing head 2 closing the splicing chamber 4, wherein the yarn holders, as represented by yarn holder 29, hold the yarn ends 31, 32 against the bottom or back side of the splicing chamber 4 opposite the insertion slot 5. The opened yarn ends 31, 32 thus lie directly at the openings of the air discharge passageways, only passageway 6 of which is shown. Compressed air supplied by the feed passageway 11 through the compressed air chamber 10 and the connector passageways 8, 9 is therefore directed through and emitted by the discharge passageways 6, 7 to directly strike the opened yarn ends 31, 32 to force them into contact with one another and the discharged air continues to circulate within the splicing chamber 4 forming air vortices which effect twisting movements of the yarn ends 31, 32 to splice them together.

Figure 4:
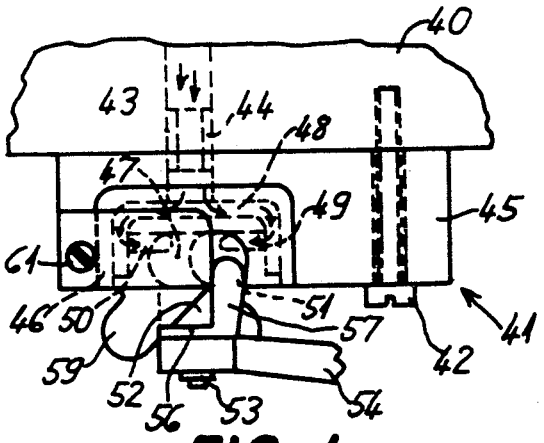
FIG. 4 is a top plan view of another yarn splicing device according to a second embodiment of the present invention.
Figure 5:
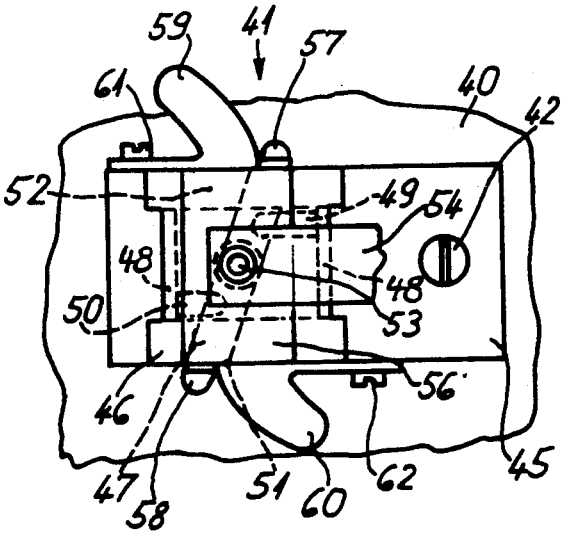
FIG. 5 is a front elevational view of the splicing device of FIG. 4.
Figure 6:
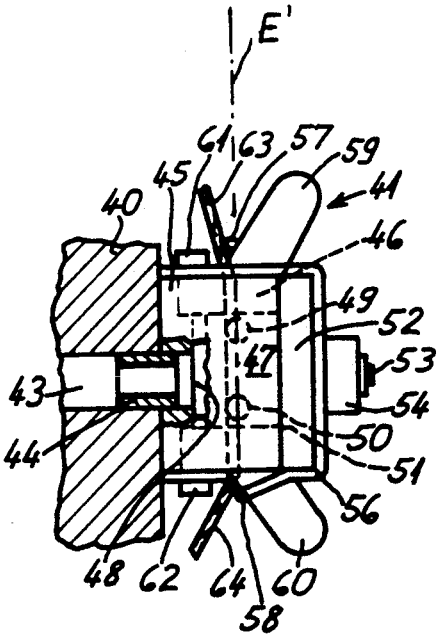
FIG. 6 is a side view of the splicing device of FIG. 4, with the splicing head shown in elevation and the base in vertical cross-section.

Referring now to FIGS. 4–6, another embodiment of the yarn splicing device of the present invention is shown. This embodiment has a bipartite splicing head 41 having two component members 45, 46 which are affixed together and are compatibly configured to define a compressed air chamber 48 therebetween for uniformly supplying compressed air to air discharge passageways 49, 50 which communicate with the chamber 48. The splicing head 41 is fastened to a base 40 by a single screw 42. As in the embodiment of FIGS. 1–3, a bore is formed through the base 40 to form a compressed air feed passageway 43 which has a conduit section 44 fitted therein and projecting outwardly therefrom for centered mounting support of the splicing head 41 while at the same time supplying compressed air thereto. In FIG. 6, the base 40 and a portion of the component member 45 are sectioned axially through the feed passageway 43 to illustrate such mounting arrangement. The component member 46 of the splicing head 41 has a recess of generally circular cross-section formed in its forward face obliquely with respect to vertical to define a splicing chamber 47 and a yarn insertion slot 51 opening thereunto. The member 46 is fitted in a compatible recess formed in the component member 45 which is affixed by the screw 42 to the base 40. A groove is milled from the rearwardly and laterally facing sides of the component 46 which are inserted within the component 45 to define the compressed air chamber 48 between the components 45 and 46 in a generally U-shape, as seen in FIG. 4. The air discharge passageways 49, 50 are formed as lateral bores in the component 46 to respectively extend oppositely from the laterally opposed regions of the milled groove in spaced relation along the length of the splicing chamber 47 in a common plane E′ at the back or bottom side thereof opposite the insertion slot 51 to open tangentially into the chamber 47 in opposite directions, as in the embodiment of FIGS. 1–3.

In this manner, compressed air delivered through the feed passageway 43 into the compressed air chamber 48 is supplied symmetrically to the air discharge passageways 49, 50 to insure that the compressed air required for splicing is fed in corresponding amounts and at corresponding rates and pressures through each of the air discharge passageways 49, 50, as indicated by the directional arrows in FIG. 4. In contrast, the feed passageway arrangements utilized in known conventional splicing devices do not assure a uniform supply of compressed air to two air discharge passageways.

As in the embodiment of FIGS. 1-3, the yarn splicing device of FIGS. 4-6 includes a cover 52 of a resilient material such as rubber or plastic supported by a plate 56 affixed by a suitable fastening device 53 to a holder arm 54, for use in sealed covering of the yarn insertion slot 51 to essentially close the splicing chamber 47 after insertion of yarn ends 63, 64 for splicing operation. The plate 56 includes extension portions 57, 58 which project respectively from the top and bottom sides of the plate 56 toward the base 40 for holding the yarn ends 63, 64 against the bottom or back side of the splicing chamber 47 opposite the insertion slot 51 to insure that the yarn ends 63, 64 are positioned within the splicing chamber 47 at the openings of the air discharge passageways 49, 50. Yarn guide members 59, 60 are affixed by screws 61, 62, respectively at the top and bottom sides of the splicing head 41 adjacent opposite lateral sides of the respective ends of the splicing chamber 47 to simplify the insertion of the yarn ends 63, 64 into the splicing chamber 47, as in the embodiment of FIGS. 1-3.

The operation of the embodiment of FIGS. 4-6 is essentially the same as above-described with respect to the first embodiment of FIGS. 1-3. FIG. 6 illustrates the position of the yarn ends 63, 64 to be spliced as guided and held by the yarn guide members 59, 60 and the yarn holders 57, 58 at the bottom or back side of the splicing chamber 47 following insertion of the yarn ends into the chamber and closing of the cover 52. In such disposition, the yarn ends respectively lie directly at the openings of the air discharge jets 49, 50 into the splicing chamber 47. Thus, the compressed air emitted from the air discharge passageways 49, 50 directly strikes the opened yarn ends and immediately initiates a swirling action of the yarn ends as the air forms air vortices, thereby to effect a twisting together of the respective yarn ends. As will be understood, in both embodiments, the direction of the twist imparted to the yarn ends is determined by the relative positioning of the air discharge passageways, each embodiment showing the air discharge passageways as arranged to impart a Z-twist, by way of example. As will be understood, a reversal of the symmetry of the air discharge passageways would result in a S-twisting of the yarn ends.

Figure 7:
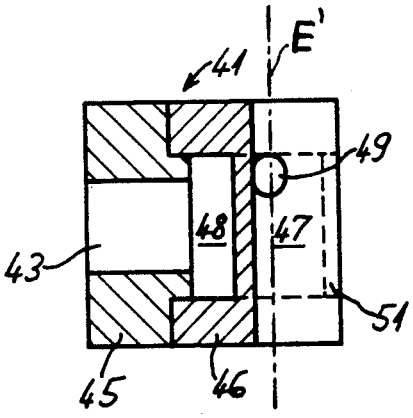
FIG. 7 is a longitudinal cross-sectional view of another embodiment of splicing head for a yarn splicing device according to the present invention.

FIG. 7 illustrates an alternative embodiment of a bipartite splicing head 41 comprising member components 45, 46, shown in cross-section taken through the longitudinal axis of the splicing chamber 47 formed in the member component 46 and through the compressed air inlet bore 43 formed in the member component 45. For sake of clarity, only the two components 45, 46 of the splicing head are illustrated.

As in the embodiment of FIGS. 4-6, the member component 45 would be mounted to a suitable base, such as the base 40, by receipt of a projecting conduit section thereof into the air inlet bore 43 and affixed to the body by a suitable fastener. Likewise, as in the embodiment of FIGS. 4-6, the component member 45 is provided with a recess for inserted receipt of the component member 46. A groove is milled in the inserted rearwardly-facing side of the component member 46 to define a compressed air chamber 48 upon assembly of the components 45, 46. Air discharge passageways are formed as bores extending laterally through opposite lateral sides of the component 46 at a spacing along the length of the splicing chamber 47 in a common plane E' at the back or bottom side of the chamber 47 opposite its entrance slot 51 for opening of the discharge passageways tangentially into the splicing chamber 47 in opposite directions. In FIG. 7, only the discharge passageway 49 is shown as a result of the section depicted.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A yarn splicing device comprising a splicing head defining a longitudinal splicing chamber and a longitudinal slot opening into said splicing chamber for insertion of yarn ends to be spliced, and passageway means formed in said splicing head for directing compressed air into said splicing chamber for effecting splicing of the yarn ends, said passageway means including a pair of air discharge passageways which extend in a common plane located at the back of said chamber opposite said slot in generally parallel spaced relation to said slot and in generally tangential relation to said chamber, said passageways being oriented in said common plane to respectively open tangentially into said chamber from opposite transverse sides thereof and in spaced relation to one another longitudinally along said chamber for contacting the yarns ends with one another in a mutually twisting manner for splicing.

2. A yarn splicing device according to claim 1 and characterized further in that said splicing chamber has a circular cross-section and each said air discharge passageway is located relatively more closely adjacent one respective longitudinal end of said chamber.

3. A yarn splicing device according to claim 1 and characterized further in that said passageway means comprises a compressed air feed passageway and a compressed air chamber for receiving compressed air from said feed passageway for delivery to said air discharge passageways, said feed passageway being arranged to open into said compressed air chamber symmetrically with respect to said air discharge passageways and perpendicularly with respect to their said common plane for uniform distribution of compressed splicing air to said air discharge passageways.

4. A yarn splicing device according to claim 3 and characterized further in that said passageway means comprises connector passageways extending respectively from said compressed air chamber to said air discharge passageways symmetrically with respect to said air discharge passageways.

5. A yarn splicing device according to claim 3 and characterized further by a base for removable mounting thereon of said splicing head, said feed passageway extending through said base and said compressed air chamber being formed in said splicing head generally at its mounting location to said base for communication with said feed passageway.

6. A yarn splicing device according to claim 5 and characterized further in that said base includes an outwardly extending conduit portion for defining a terminal end portion of said feed passageway, and said splicing head comprises a mounting opening for receiving said conduit portion of said base.

7. A yarn splicing device according to claim 6 and characterized further in that a terminal portion of said mounting opening forms said compressed air chamber and said passageway means comprises connector passageways extending respectively from said compressed air chamber to said air discharge passageways symmetrically with respect to said air discharge passageways.

8. A yarn splicing device according to claim 3 and characterized further in that said splicing head comprises first and second members defining therebetween said compressed air chamber, said first member defining said splicing chamber and said second member being removably mounted to said base.

9. A yarn splicing device according to claim 1 and characterized further in that said splicing head includes yarn guide devices for assisting in inserting the yarn ends through said slot into said splicing chamber.

10. A yarn splicing device according to claim 1 and characterized further by a cover for covering said splicing chamber during splicing.

11. A yarn splicing device according to claim 1 and characterized further in that said cover includes yarn holders for retaining the yarn ends within said splicing chambers.

* * * * *